United States Patent [19]

Penza, Jr.

[11] 4,207,695

[45] Jun. 17, 1980

[54] MECHANICAL WRITING INSTRUMENT

[76] Inventor: Carmine Penza, Jr., 813 S. First Rd., Hammonton, N.J. 08037

[21] Appl. No.: 906,842

[22] Filed: May 17, 1978

[51] Int. Cl.[2] ..... G09F 3/00

[52] U.S. Cl. ..... 40/334

[58] Field of Search ..... 40/334, 335, 111; 401/195, 52

[56] References Cited

U.S. PATENT DOCUMENTS

| | | | |
|---|---|---|---|
| 2,262,818 | 11/1941 | Reese | 40/334 |
| 2,971,283 | 2/1961 | Parker | 40/334 |
| 3,123,291 | 3/1964 | Madry | 40/335 X |
| 3,738,037 | 6/1973 | Daley | 40/334 X |

*Primary Examiner*—Louis G. Mancene
*Assistant Examiner*—Wenceslao J. Contreras
*Attorney, Agent, or Firm*—Thomas A. Lennox

[57] ABSTRACT

A mechanical writing instrument is provided with conversion equivalent displayed from within the instrument. An outer casing has a plurality of slots through which conversion tables around an inner shell may be selectively viewed by turning an adjustment cap which also protracts and retracts the ballpoint pen tip.

7 Claims, 5 Drawing Figures

MECHANICAL WRITING INSTRUMENT

BACKGROUND OF THE INVENTION

The device of this instrument is a writing instrument. Throughout the disclosure, reference will be made to various types of writing instruments and in particular ball point pens, which is preferred for use with this invention. It will be seen that any type of writing or marking instrument may be used in my invention, including mechanical pens, such as ball point, felt marking, hard tipped marking, metal fountain and other types, mechanical pencils, standard pencils, and all other types of marking instruments.

While the exact type of writing instrument is not critical to this invention, it will be seen that the advantage of having the means to write in the same instrument that provides conversion tables or other reference material will have a great advantage to the user.

In the country of the United States there has been a long standing usage of the English system of measurements. Recently, decision has been made to convert to the metric system to bring the country's usage more in alignment with that of the rest of the world. Unfortunately, most of the residents of the United States have been taught only the English system and have used it throughout their lives. Learning the metric system and, in particular, the problem of converting English measurement over to the metric equivelant is very difficult and places quite a burden on the residents of the United States.

It is, thus, most desirable that the person be able to readily convert between English and metric systems as the person is handling other duties. For example, the increasing use of metric weights and measures requires that the person be ready to convert the measurements in order to comparison shop. It is usually necessary to use a writing instrument for such comparison and this inventor has realized the advantage of combining the two needs in one instrument.

While the use of metric conversion is an immediate need, it will be apparent to the reader that conversion tables of all types will be useful and can be applied in my invention. In addition, the selective presentation of a variety of types of data including multiplication tables and the like can easily be inserted in my invention and used to the great advantage of the user.

It is therefore, an object of this invention, to provide a writing instrument which will selectively display written indicia to the viewer without causing the writer to refer to any other source material.

It is an additional object of this invention to provide a writing instrument which will combine the selection of the indicia with the working mechanism of the mechanical writing instrument and that through that commonality, offer the advantage of compactness, simplicity and reduced cost.

It is an additional object of this invention to provide a writing instrument which will selectively display, under the user's control, a series of conversion formulas which will allow the user to convert from one weight measure system to another.

DESCRIPTION OF THE PRIOR ART

There have been a number of mechanical pens and pencils capable of displaying indicia but none have disclosed the present invention nor satisfied the objects listed above.

In U.S. Pat. No. 3,378,037, to Daley, he describes a magnifying tubular assembly means with a shell with indicia on the outer surface, and opaque sleeve through which are provided indicia reading holes and an outside clear casing, all of which are essentially in tubular form. In the Daley apparatus, there is no interconnection between the placement of the pencil lead or point and the selective viewing of the indicia. Daley provides an adapter to a pencil and it is a mere addition to the writing instrument.

In U.S. Pat. No. 2,262,818 to Reese, a pencil having a series of tubular indicia reading sleeves are provided. Again, there is no interconnection between the sleeve and the pencil mechanism.

J. P. O'Keefe in U.S. Pat. No. 1,885,541, discloses a chart moved on rollers inside a mechanical pencil which is viewed through a port in the pencil body.

In U.S. Pat. No. 4,030,842, to White, et al, a flexible sheet may be drawn from the interior body of the mechanical pen and allowed to retract when finished.

In two early patents, U.S. Pat. No. 1,830,102 to Felsenthal and U.S. Pat. No. 2,347,144 to Wilkins, display pencils are disclosed wherein indicia is placed inside a transparent cylinder which is placed on the outside or is part of the body of the pencil, both for advertisement purposes.

SUMMARY OF THE INVENTION

This invention is directed to a mechanical writing instrument and is preferably used with a ball point pen. The writing instrument has a writing point capable of protraction and preferably also retraction from the end of the instrument. An outer casing, generally tubular in shape, is formed to fit the hand for writing, and be of a shape such that the writing point may be protracted from one end. A plurality of viewer ports are spacedly located along the outer casing, preferably in one or two rows along the length of the casing. An inner shell fits within the tubular portion of the outer casing and is capable of rotating relative to the outer casing. Indicia is provided in conjunction with the inner shell spacedly located circumferentially around the inner shell having at least one series of indicia for each viewer port and positioned to be selectively displayed as the inner shell is rotated relative to the outer casing. An adjustment cap is rotatably fixed to the non-writing end of the writing instrument. A movement means connected to the adjustment cap and to the writing system provides that when the cap is rotated the writing means will protract and preferably retract upon full rotation of the cap. A connecting system between the inner shell and the adjustment cap provides that the inner shell and the indicia will rotate relative to the outer casing upon rotation of the adjustment cap. It is preferred that the written indicia be placed on a piece of paper and inserted inside the inner shell which is essentially in the shape of a transparent tube.

DESCRIPTION OF PREFERRED EMBODIMENTS

Figure 1:
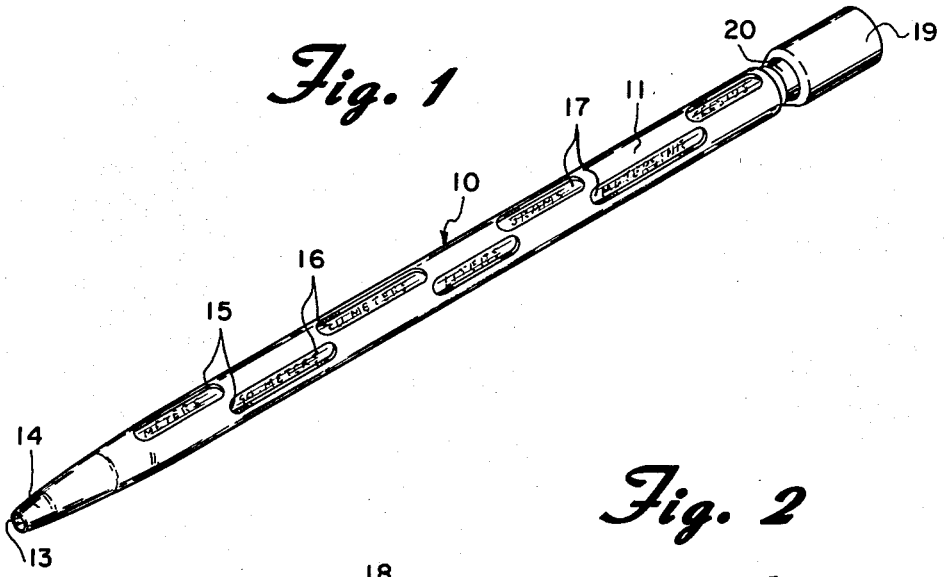
FIG. 1 is a perspective view of a writing instrument of this invention.

In FIG. 1 a perspective view of writing instrument pen of this invention is provided. Our casing 11 houses a mechanical ball point pen cartridge partially shown in FIG. 2 with point 13 extending out through end 14 of casing 11. A series of slots 15 are spaced in two rows along casing 11. Casing 11 may be cast metal, extruded metal, injection molded thermoplastic, such as polystyrene and other similar metarials. Casing 11 is opaque so as to hide the printed indicia 16 which is positioned for selective display through slots 15. In this embodiment, indicia 16 is printed on paper tube 17 shown in FIG. 4 which fits inside transparent tube 18 which fits in and is able to rotate freely within casing 11. Adjustment cap 19, is hollow and fits over casing extension 20.

Figure 2:
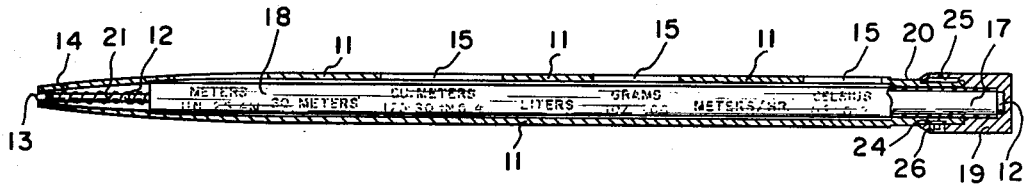
FIG. 2 is a longitudinal cross-section of the outer casing to show the inner construction of the writing instrument of FIG. 1.
Figure 3:
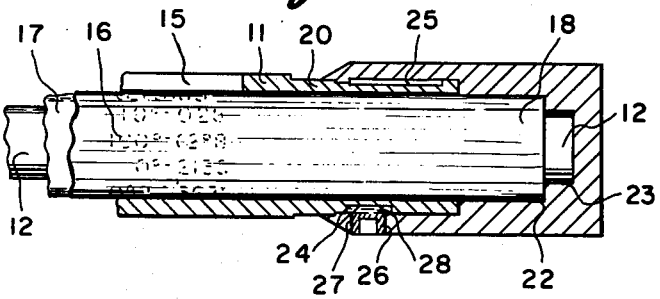
FIG. 3 is an expanded cross-sectional view of the internal mechanism of the non-writing end of the instrument in FIG. 1.
Figure 5:
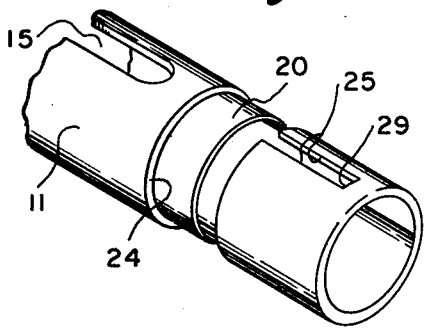
FIG. 5 is a perspective view of the extension of the instrumentation inside the working mechanism.

The cross-sectional view in FIG. 2 is a longitudinal cross-section of casing 11 and a partial cross-section of the internal mechanism on the back of writing instrument pen. In this view, pen point 13 is shown held just within end 14 by compressor spring 21 which holds point 13 and pen cartridge 12 within casing 11. Paper tube 17 is shown with the indicia in circumferencially spaced rows in position to be viewed through slots 15. Adjustment Cap 19 bears against the back end of pen cartridge 12 and is force fitted around transparent tube 18. The attachment between cap 19 and tube 18 may be merely a forced fit but must also be adhesively attached, heat welded or even glued to prevent relative rotation between the two parts. As cap 19 is rotated, tube 18 along with paper tube 17 is rotated such that the printed indicia 16 may be selectively viewed through slots 15. FIG. 3 is an expanded cross-sectional view of the adjustment cap 19 mechanism. Transparent tube 18 is force fitted into cavity 22 in cap 19. Paper tube 17 on which indicia 16 is printed fits within tube 18 and moves with the tube. It will be apparent that the indicia need not be on a separate paper but may be printed on the inside or outside of tube 18. It is preferred that the indicia be on a separate tube of paper to allow interchanging of the printed indicia. Pen cartridge 12 extends inside paper tube 17 and abuts the inside of cap 19 at the end of cavity 23. Cavities 22 and 23 are merely circular bores in cap 19. On casing extension 20 is machined annular channel 24 and longitudinal channel 25 which are more easily pictured in FIG. 5, which is a perspective view of extention 20. Allen screw 26 is screwed into threaded hole 27 so that end 28 fits in and slides in annular channel 24 and longitudinal channel 25. When screw 26 is in longitudinal channel 25, spring 21 forces pen cartridge 12 against cap 19 which in turn forces Allen screw 26 against end 29 of longitudinal channel 25, placing pen point 13 in a retracted position inside casing end 14. When cap 19 is pressed forward, spring 21 is compressed and Allen screw end 28 slides along channel 25 until point 13 is protracted and is in the writing position. By retaining pressure on cap 19, it is turned such that Allen screw end 28 follows annular channel 24 locking point 13 in the protracted position. Further turning of cap 19 causes Allen screw end 28 to ride in annular channel 24 to display the chosen indicia. Upon further turning of cap 19 Allen screw 28 is aligned with longitudinal channel 25 and will automatically retract, as long as forward pressure is released from cap 19.

Figure 4:
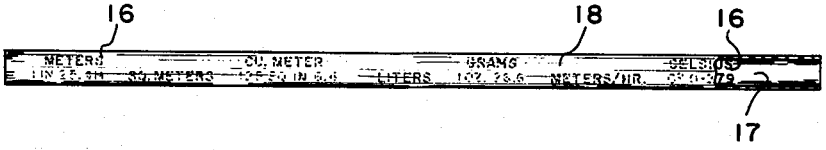
FIG. 4 is a side view with a partial cross-section of the paper cylinder in which the indicia is provided inside the writing instrument in FIG. 1.

The combination of transparent tube 18 and paper tube 17 is shown in FIG. 4. Indicia 16 is shown through tube 18, but is printed on paper tube 17 which slides inside and moves with tube 18.

While this invention has been described with reference to the specific embodiments disclosed herein, it is not confined to the details set forth and the patent is intended to include modifications and changes which may come within and extend from the following claims.

I claim:

1. A mechanical writing instrument having a writing means capable of protraction from the end of the writing instrument, comprising:

(a) an opaque outer casing generally cylindrical in shape, (b) a plurality of indicia revealing ports through the outer casing located along the length of the casing, (c) a first inner transparent cylindrical shell, fitting within the outer casing and capable of being rotated relative to the outer casing, (d) a second inner shell fitting within the first inner shell moving with the first inner shell and having printed indicia located in circumferentially spaced rows around the second inner shell placed such that each row of indicia is positioned in alignment for each port in the outer casing, (e) an adjustment cap, rotatably affixed to the writing instrument, (f) protraction movement means connected to the adjustment cap and to the writing means such that when the cap is moved the writing means will protract, and (g) connecting means between the first inner shell and the adjustment cap such that both inner shells will rotate relative to the outer casing upon rotation of the adjustment cap.

2. The mechanical writing instrument of claim 1 wherein the writing means is a ball point pen.

3. The mechanical writing instrument of claim 1 wherein the ports are five to nine slots positioned in two horizontal lines each line positioned apart a small radial distance.

4. The mechanical writing instrument of claim 1 wherein the first inner shell is a plastic transparent cylindrical tube and the second inner shell on which the printed indicia is printed is a piece of paper inserted inside the inner shell.

5. The mechanical writing instrument of claim 1 wherein a retraction spring is placed inside the writing instrument to bear upon the writing means pressing it within the end of the writing instrument, and wherein the protraction movement means comprises (a) an annular channel around the outside of the body extension, (b) a second channel extending longitudinally from and opening into the annular channel away from the writing means a distance along the body extension to a channel end, and (c) a channel guide rigidly extending from the inside bore of the adjustment cap and slidably fitting into the channels, wherein the distance of the second channel and the position of the guide is such that pressure on the cap will protract the writing means and rotating the cap will cause the channel guide to slide in the annular channel and retract the writing means when the guide reaches the second channel.

6. The mechanical writing instrument of claim 1 wherein the outer casing covers at least half of the outer surface of the mechanical writing instrument.

7. The mechanical writing instrument of claim 1 wherein movement of the cap will protract the writing means and upon full rotation of the cap, the writing means will retract.

* * * * *